US011053697B2

(12) United States Patent
Randjelovic

(10) Patent No.: US 11,053,697 B2
(45) Date of Patent: Jul. 6, 2021

(54) SUBFLOOR ASSEMBLY ON A SUPPORT SUBSTRATE

(71) Applicant: Erlin A. Randjelovic, Crystal Falls, MI (US)

(72) Inventor: Erlin A. Randjelovic, Crystal Falls, MI (US)

( * ) Notice: Subject to any disclaimer, the term of this patent is extended or adjusted under 35 U.S.C. 154(b) by 0 days.

(21) Appl. No.: 17/067,200

(22) Filed: Oct. 9, 2020

(65) Prior Publication Data

US 2021/0115682 A1 Apr. 22, 2021

Related U.S. Application Data

(60) Provisional application No. 62/916,928, filed on Oct. 18, 2019.

(51) Int. Cl.
*E04F 15/22* (2006.01)
*E04F 15/04* (2006.01)

(52) U.S. Cl.
CPC ..... *E04F 15/225* (2013.01); *E04F 15/04* (2013.01)

(58) Field of Classification Search
CPC ..... E04F 15/225; E04F 15/04
See application file for complete search history.

(56) References Cited

U.S. PATENT DOCUMENTS 498,344 A * 5/1893 Williams ..... E04F 15/04 52/403.1
1,302,578 A 5/1919 Murphy
1,587,355 A 6/1926 William
2,046,593 A 7/1936 Urbain
2,862,255 A * 12/1958 Nelson ..... E04F 15/225 52/403.1
4,879,857 A 11/1989 Peterson et al.
4,890,434 A 1/1990 Niese
5,016,413 A 5/1991 Counihan
5,253,464 A * 10/1993 Nilsen ..... E04F 15/22 52/508
5,277,010 A 1/1994 Stephenson et al.
5,365,710 A 11/1994 Randjelovic
5,682,724 A 11/1997 Randjelovic
(Continued)

FOREIGN PATENT DOCUMENTS

DE 19940837 A1 * 11/2000 ..... E04F 15/02144

OTHER PUBLICATIONS

ASET Services; "ASTM Introduces New Indoor Court Standard: F2772 Athletic Performance of Indoor Sport Systems"; article; published in the United States at least as early as Jun. 2, 2019; 3 pages; United States.

(Continued)

*Primary Examiner* — Adriana Figueroa
(74) *Attorney, Agent, or Firm* — Epiphany Law, LLC

(57) ABSTRACT

A subfloor assembly that supports a flooring section on a substrate. The subfloor assembly includes a subfloor section and a resilient component. The subfloor section includes an offset groove in an underside of the subfloor section. The offset groove is defined by a side of the groove spaced apart from an opposing side of the groove and a ceiling spanning between the side and the opposing side and sloped relative to an upper surface of the substrate. The resilient component is positioned in the offset groove and between the ceiling and the upper surface of the substrate.

23 Claims, 4 Drawing Sheets

(56) References Cited

U.S. PATENT DOCUMENTS

| | | | | |
|---|---|---|---|---|
| 5,761,867 | A * | 6/1998 | Carling | E01C 13/045 52/177 |
| 6,122,873 | A | 9/2000 | Randjelovic | |
| 7,127,857 | B2 * | 10/2006 | Randjelovic | E04F 15/225 52/403.1 |
| 7,694,480 | B2 | 4/2010 | Niese et al. | |
| 7,703,252 | B2 * | 4/2010 | Randjelovic | E04F 15/225 52/403.1 |
| 7,735,281 | B2 * | 6/2010 | Randjelovic | E04F 15/225 52/403.1 |
| 7,832,165 | B2 | 11/2010 | Randjelovic | |

OTHER PUBLICATIONS

ASET Services; "EN 14904: Introduction to Performance Types"; educational document; Copyright 2004; 4 pages; United States.

International Basketball Federation Association; "FIBA Equipment Rules 2020"; article; published in the United States at least as early as Jun. 2, 2019; pp. 17 and 18 (2 pages total); United States.

Maple Flooring Manufacturers Association; "MFMA PUR Standards: Performance & Uniformity Rating Sport Specific Standards"; educational document; published in the United States at least as early as Jun. 2, 2019; 4 pages; United States.

* cited by examiner

SUBFLOOR ASSEMBLY ON A SUPPORT SUBSTRATE

CROSS-REFERENCE TO RELATED APPLICATION

This application claims the benefit of U.S. Provisional Application No. 62/916,928, filed Oct. 18, 2019, and titled: RESILIENT PAD ALIGNMENT FOR ACTIVITY FLOORS.

TECHNICAL FIELD

This invention relates to a manner in which subfloor assemblies are fabricated to position attached resilient components and provide a desired and uniform reaction to impacts occurring on active floor surfaces. This includes floors commonly found in gymnasiums, stages, racquet courts, and exercise/dance applications, for example. More particularly, the invention relates to subfloor assemblies in which one or more determined location includes sloped areas for placement of resilient components relative to a support substrate.

BACKGROUND

Hardwood athletic floor systems have developed from the inclusion of especially rigid subfloors used in factory and commercial applications to the commonality of highly resilient floors now serving activities in such facilities as gymnasiums, exercise rooms and stage floor applications. The initial inclusion of resilient components was introduced to principally provide deflection of the floor surface when impacted, thereby providing shock absorbing value for the floor's active user(s). U.S. Pat. No. 2,862,255 by S. D. Nelson illustrates early introduction of resilient components for inclusion below activity floors Efforts have been made since the introduction of resilient components to address various pressure applied on active floors, i.e. light impacts from smaller or single players vs. aggressive impacts created by larger or multiple players in close proximity. Whereas soft elastic components are desired for non-aggressive impacts, such material when easily deflected does not provide desired shock absorbing value for aggressive athletic loads if already significantly compressed when small additional pressure is applied. Conversely elastomers that resist compression to enhance aggressive loads do not satisfy required deflection in regard to light impacts. Numerous efforts have been made to simultaneously address light and aggressive impacts through resilient component and subfloor designs. Such examples as U.S. Pat. No. 4,879,857 by D. Peterson and U.S. Pat. No. 5,365,710 by E. Randjelovic illustrate designs intended to provide differing support from elastomers as load pressure increases. The design of U.S. Pat. No. 7,127,857 shows a manner in which subfloor sections play a part to address the wide range of athletic impacts. However, none of these are completely satisfactory to address the needs for flooring surfaces today.

SUMMARY

To overcome one or more deficiency in the prior existing materials or systems, there is provided a manner in which resilient components are sloped rather than positioned parallel to the supporting substrate, thereby pressuring one edge of the resilient sections initially. The sloped profile can then introduce even and gradual increase in resilient component support for consistent reaction to added pressure to the active floor surface.

In some embodiments there is a subfloor assembly that supports a flooring section on a substrate. The subfloor assembly includes a subfloor section including an offset groove in an underside of the subfloor section. The offset groove is defined by a side of the groove spaced apart from an opposing side of the groove and a ceiling spanning between the side and the opposing side and sloped relative to an upper surface of the substrate. The subfloor assembly also includes a resilient component positioned in the offset groove and between the ceiling and the upper surface of the substrate.

In other embodiments there is a subfloor assembly that supports a flooring section on a substrate. The subfloor assembly includes a subfloor section including an offset groove in an underside of the subfloor section. The offset groove is defined by a side of the groove spaced apart from an opposing side of the groove and a ceiling spanning between the side and the opposing side and sloped relative to an upper surface of the substrate. The subfloor assembly also includes a resilient component that has a rectangular cross-sectional profile. The resilient components is positioned in the offset groove between the ceiling and the upper surface of the substrate, is a substantially homogenous resilient elastic material, and has a positioned-width contained substantially completely within a width-profile of the offset groove defined by the side of the groove spaced apart from the opposing side of the groove.

In still other embodiments there is a subfloor assembly that supports a flooring section on a substrate. The subfloor assembly includes a subfloor section including an offset groove in an underside of the subfloor section. The offset groove is defined by a short wall of the groove spaced apart from and substantially parallel to an opposing long wall of the groove with a ceiling adjoined to an inside end of each wall and spanning between the walls. The long wall extends a greater depth into the groove than the short wall. The subfloor assembly also includes a resilient component that has a 90-degree parallelogram cross-sectional profile. The resilient component is positioned in the offset groove between the ceiling and the upper surface of the substrate and has a resilient elastic modulus where the modulus is substantially uniform throughout a thickness of the resilient component.

Also described herein are embodiments directed to features of the resilient component itself and in relation to other components, features of the offset groove and multiple offset grooves in a subfloor assembly and other sections of the subfloor assembly.

As used herein, "sloped" (and formatives thereof) means a plane defined by a stated surface and the plane being non-parallel to the support substrate including being within plus or minus about 15 degrees, preferably about 10 degrees and most preferably about 5 to 10 degrees of non-parallel relative to the support substrate.

As used herein, "adjoin" (and formatives thereof) means next to or joined with.

BRIEF DESCRIPTION OF THE DRAWINGS

The invention may be more completely understood in consideration of the following detailed description of various embodiments of the invention in connection with the accompanying drawings, in which.

FIG. A is a bottom view of a subfloor panel made according to the present invention and showing an enlarged view of a portion thereof.

Figure 10:
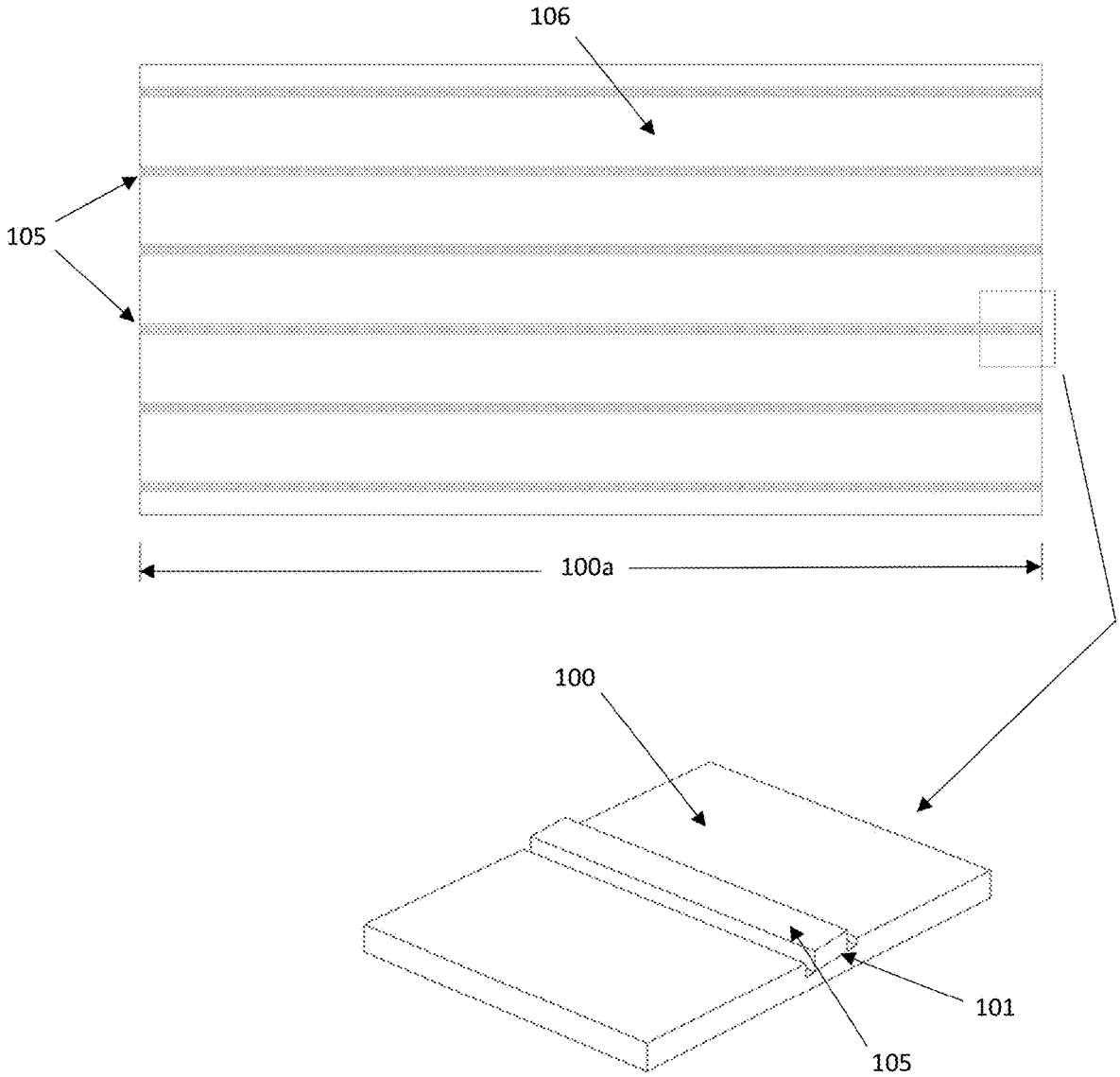

The drawings show some but not all embodiments. The elements depicted in the drawings are illustrative and not necessarily to scale, and the same (or similar) reference numbers denote the same (or similar) features throughout the drawings.

DETAILED DESCRIPTION

In accordance with the practice of at least one embodiment of the invention, as seen in FIGS. 4-7, for example, there is a subfloor assembly 10 that supports a flooring section 108 on a substrate 110. The subfloor assembly 10 includes a subfloor section 100 having an offset groove 101 in an underside 102 of the subfloor section. The offset groove is defined by a side 103 of the groove spaced apart from an opposing side 104 of the groove 101 and a ceiling 101*a* spanning between the side 103 and the opposing side 104 and sloped relative to an upper surface 110*a* of the substrate 110. A resilient component 105 is positioned in the offset groove 101 and located between the ceiling 101*a* and the upper surface 110*a* being supported by the substrate 110.

Surprisingly, it was found that the offset groove in combination with a resilient component taught herein could efficiently and reliably provide desired shock absorbing response when impacted with forces associated with recreation, exercise, dance, and sports activities. And, this is so for loads from the weight of the flooring itself to light loads to medium loads to excessive loading and unloading and reloading, time and time again. Without being limited to a theory of understanding, such advantage(s) of the subfloor assembly can be achieved through various embodiments disclosed herein.

For example, the slope of the groove may be designed by the side 103 being a short wall and the opposing side 104 being a long wall, such that the long wall extends a greater depth into the groove 101 than the short wall and each wall adjoins the ceiling. Said another way, ceiling 101*a* can be adjoined to an inside end 103*a*, 104*a* of each wall and spanning between the walls such that the long wall extends a greater depth into the groove than the short wall. Preferably the ceiling is a flat surface extending from side 103 to opposing side 104. More preferably, the short wall is substantially parallel to the long wall along the length 101*a* of section 100.

Figure 4:
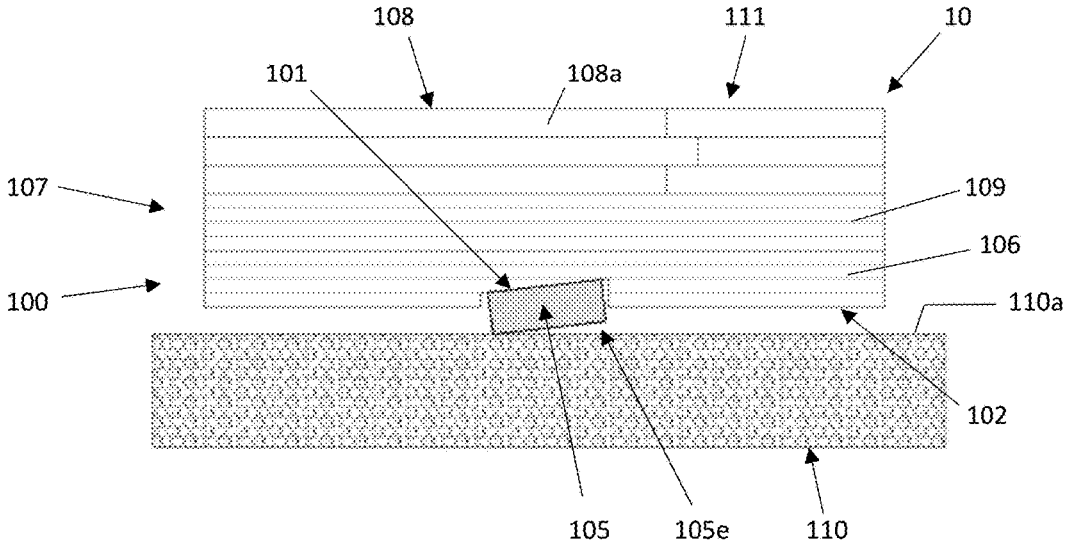
FIG. 4 is an end view of a portion of a subfloor assembly showing a resilient component in an unloaded state and located between the subfloor section and a support substrate.

As another example, the resilient component 105 can have a resilient elastic modulus that recovers to at least 90% of its original, non-compressed configuration, more preferably to at least 95% of its original, non-compressed configuration, still more preferably to at least 98% of its original, non-compressed configuration and most preferably to about 100% of its original, non-compressed configuration, when a load is removed from the component. In this regard, preferably a gap 105*e* is formed between the resilient component and the upper surface of the substrate when the subfloor assembly is in an unloaded state. As used herein, the unloaded state is when there is substantially only the weight of the subfloor assembly 10 loading the resilient component, as seen in FIG. 4. FIG. 4 is an end view of subfloor assembly 10 with a midflooring section 107 including upper plywood midfloor panel 109 and located under a flooring section 108 of flooring panel 108*a* and above subfloor section 100 that includes subfloor panel 106. Preferably about a 3/16 inch to about a 5/16 inch gap is allowed between the underside 102 of the subfloor section 100 and surface 110*a* of the concrete substrate 110. And, this gap can be adjusted depending on the configuration of the offset groove and the design of the resilient component, all to give the desired floor responsiveness as taught herein.

Figure 5:
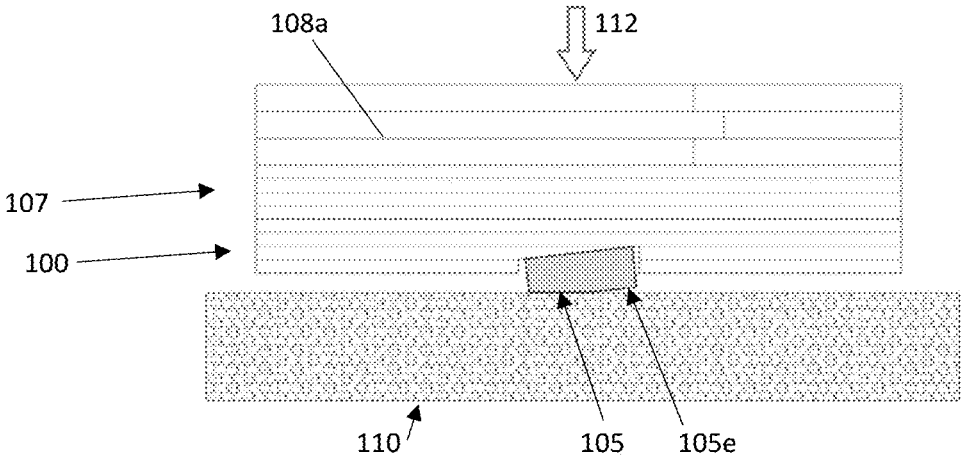
FIG. 5 is an end view of the subfloor assembly in FIG. 4 but now showing reaction of a resilient component when impacted by light to moderate pressure.
Figure 6:
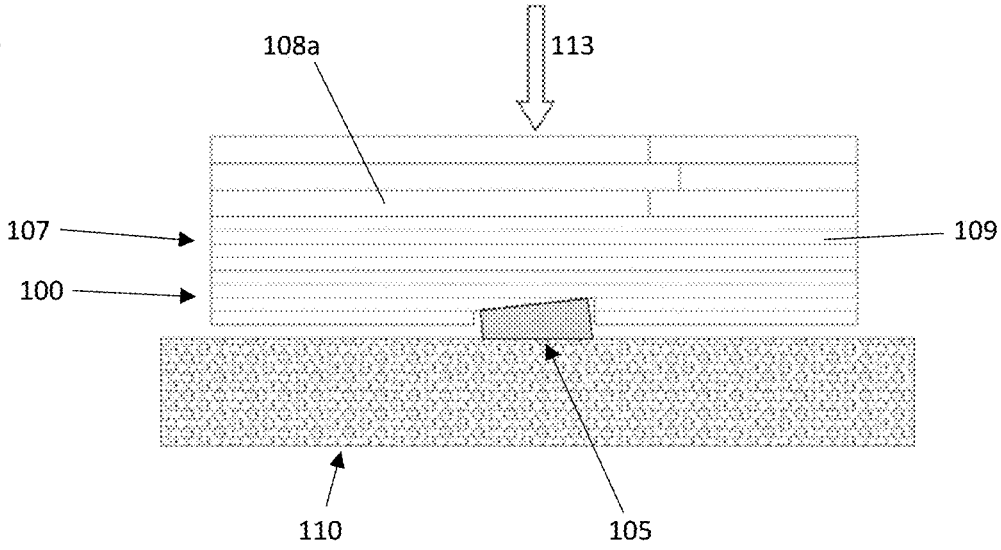
FIG. 6 is an end view of the subfloor assembly in FIG. 4 but now showing reaction of a resilient component when impacted by moderate to heavy pressure.
Figure 7:
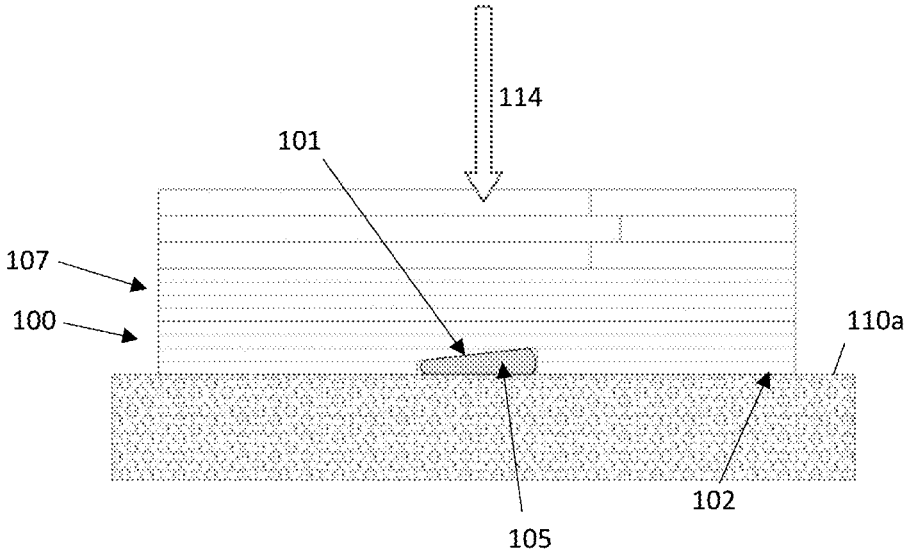
FIG. 7 is an end view of the subfloor assembly in FIG. 4 but now showing reaction of a resilient component when impacted by excessive pressure.

Further in this regard, FIG. 5 is an end view of the subfloor assembly shown in FIG. 4, but now in which light to moderate pressure 112 on the flooring surface 108 creates increased contact of the resilient component 105 to the concrete substrate 110. Preferably, even here, there can still be a gap 105*e* between the bottom surface of component 105 and upper surface 110*a*. And then, in FIG. 6 an end view in which added pressure 113 is applied on the flooring surface 108, further contact is made between the underside of the resilient component 105 and the concrete substrate 110 as the resilient member is depressed and deformed even more, and preferably, substantially no gap exists between the resilient component and the upper surface of the substrate when the subfloor assembly is in this loaded state. Then, turning to FIG. 7 is an end view in which excessive pressure 114 beyond aggressive athletic impacts, such as bleachers, portable goals and maintenance equipment, impacts the assembly 10, and the resilient component 105 remains housed within the offset groove 101 as the underside 102 of the subfloor section 100 rests fully on the surface 110*a* of the concrete substrate 110. That is, even in this heavily loaded state, and especially when less loaded, the resilient component preferably has a positioned-width 105*d* (FIG. 2) contained substantially completely within a width-profile 101*b* (FIG. 1) of the offset groove 101. Such profile 101*b* is defined by the side 103 of the offset groove spaced apart from the opposing side 104 of the offset groove. More preferably, the positioned-width 105*d* of the resilient component is contained substantially completely within the profile of the offset groove when the subfloor assembly is in any of the loaded states, including excessively loaded. As used herein, the positioned-width 105*d* is defined as the maximum width of the resilient component in any of its states from unloaded to excessively loaded.

In other examples, design and/or construction particulars of the resilient component can be adjusted to achieve preferred results. For example, the resilient component 105 can have a resilient elastic modulus where the modulus is substantially uniform throughout a thickness of the resilient component. Additionally, or alternately, the resilient component can be a substantially homogenous resilient elastic material. Still additionally or alternately, the resilient component can have a 90-degree parallelogram cross-sectional profile, and preferably the cross-sectional profile is rectangular. With one or more of these features, an even more responsive and enduring athletic floor can be provided.

Figure 3:
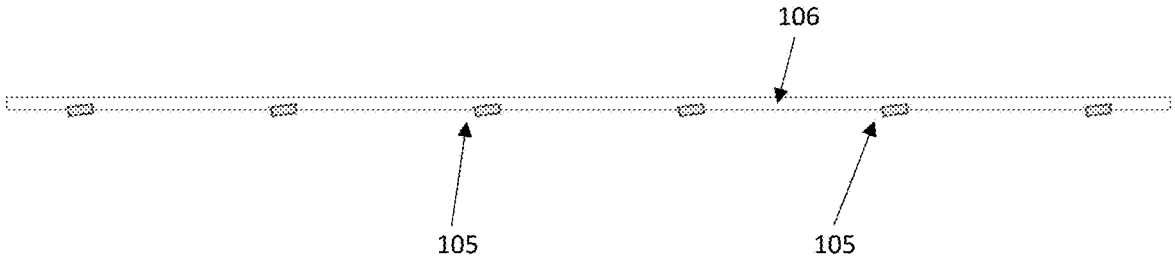
FIG. 3 is an end view of the subfloor section seen in FIG. A including numerous resilient components.

In still other examples, Figure A shows a bottom view of a subfloor panel 106 in which the subfloor section includes at least two offset grooves on the underside of the subfloor section and a resilient component 105 is located in each offset groove. Preferably, each offset groove is spaced from each other offset groove, and more preferably, substantially uniformly so (except maybe closer to the perimeter of the section where it is not quite possible). An expanded view of a portion of section 100 of the bottom of the subfloor panel 106 is shown as a perspective detail to illustrate the resilient component 105 as housed within the machined offset groove 101. FIG. 3 is an end view of the subfloor panel 106 seen in Figure A. As shown the subfloor panel is provided by machining typical construction grade plywood, and it is understood that other materials that can be machined or molded can be used as well and are covered here as well. Examples of such material include composite wood panels, dimensioned lumber, as well as machinable and moldable plastics. Additionally, in a constructed athletic floor, there will be multiple subfloor assemblies 10 adjoining each other, and these held together by means beyond the scope of this disclosure.

Figure 8:
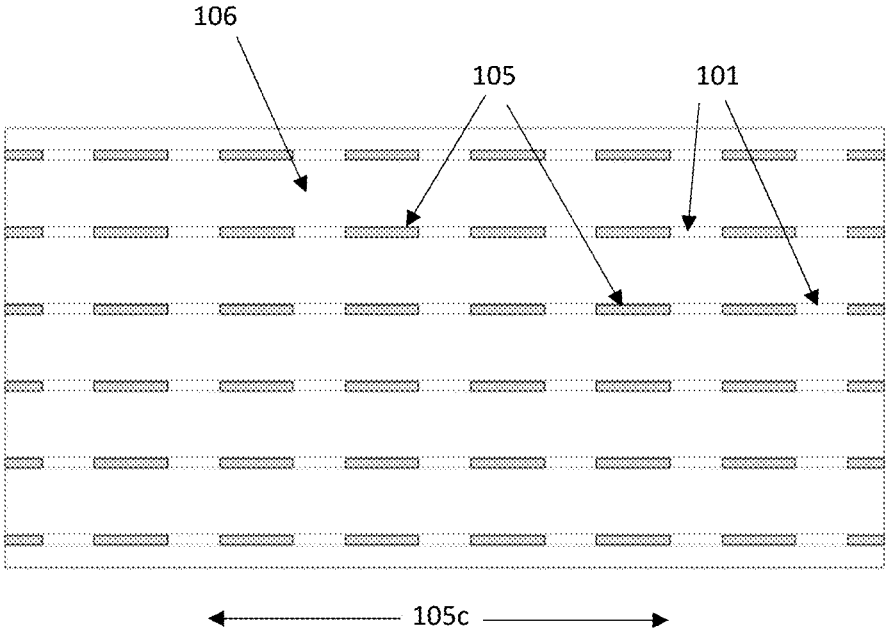
FIG. 8 is a bottom view of the subfloor panel like that seen in FIG. A but showing an alternate embodiment of the invention.
Figure 9:
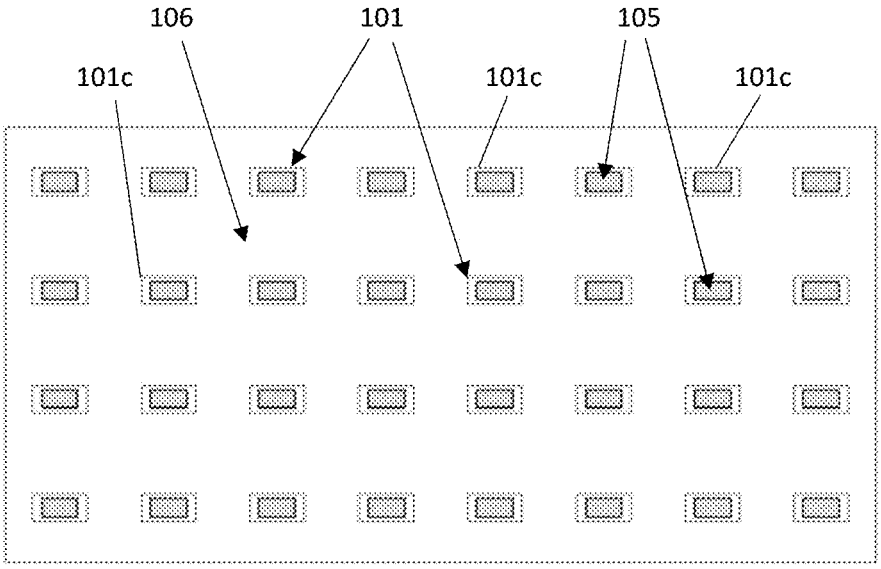
FIG. 9 is a bottom view of the subfloor panel like that seen in FIG. A but showing yet an alternate embodiment of the invention.

Further in these regards, the subfloor section has a length 100*a* and the groove can extend a distance substantially coextensive with the length of the subfloor section. Additionally, the resilient component has a component length (in dimension 105*c*, FIG. 8 for example) and the component length can be substantially coextensive with the length of the subfloor section (as in FIG. A). Alternatively, the resilient component 105 can have a component length less than the length of the subfloor section (as seen in FIGS. 8 and 9) and/or the resilient component can be at least two spaced apart resilient components. This spacing can be laterally spaced (as in FIGS. A, 3, 8 and 9) and/or longitudinally spaced (as in FIGS. 8 and 9) or both laterally spaced and longitudinally spaced (as in FIGS. 8 and 9). Additionally, or alternatively, at least two spaced apart resilient components 105 can be sized substantially the same (as depicted in all FIGs).

Figure 1:
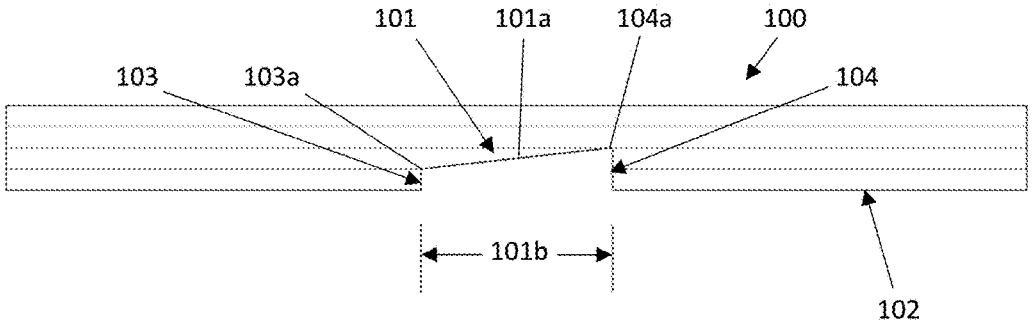
FIG. 1 is an end view of a portion of subfloor section including the subfloor panel seen in FIG. A.
Figure 2:
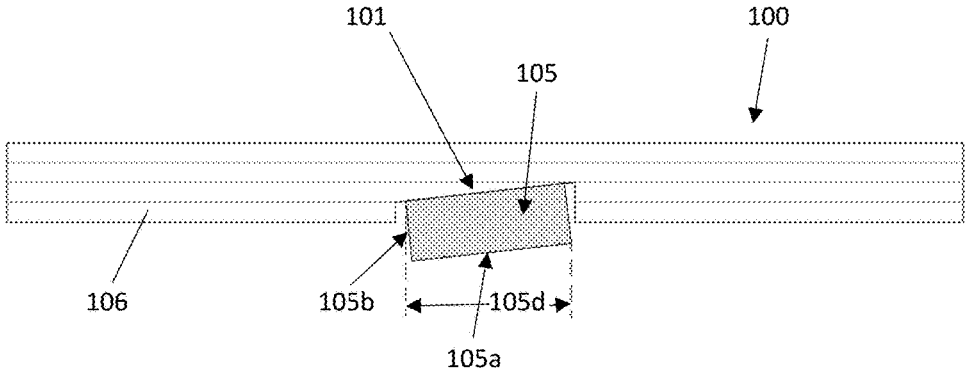
FIG. 2 is an end view of the subfloor section as shown in FIG. 1 with the inclusion of a resilient component.

In some preferred aspects, FIGS. 1 and 2 depict an end view of a portion of subfloor section 100 with an angled/sloped machined offset groove 101 located on the underside 102 of the subfloor panel 106. Depth and angle/slope of machined grooves are dependent on subfloor material thickness, resilient component thickness 105*b*, and resilient elastic modulus of resilient component. In an embodiment in which conventional one-half inch×48 inch×96 inch plywood is used, the machined groove can measure about 1 and ¼ inch wide with the short wall 103 measuring ⅛ inch depth into the underside running opposite and parallel to the long wall 104 measuring ⅛ inch depth into the underside and creating an approximate 6-degree to 7-degree angle for ceiling 101*a*. Resilient component material in this example can measure ⅜ inch thick in dimension 105*b* and 1 inch wide in dimension 105*a* and be in 96 inch lengths in dimension 105*c* (FIG. 8). The resilient component can measure from about ¾ inch to about 2 inch in width dimension 105*a* with density ranging from about 10 to 40 pounds per cubic foot (pounds per cubic foot, as determined by one of ordinary skill in the art using the athletic floor industry standard for measuring this parameter, herein called "PCF"). That is, the PCF value for materials used (foam/rubber/rubber or foam combination) to make resilient components for the subfloor assembly is dependent on the material type and dimensions, and generally ranges from about 10 PCF to 40 PCF. For example, if a resilient composite section has a width of about 1 inch, thickness of about ½ inch and length of about 4 inches, then its PCF is preferably about 30 PCF (or in the range of 25 PCF to 35 PCF). However, when for example, a resilient composite section has a width of about 1 inch, thickness of about ½ inch and length of about 8 inches to 12 inches, then its PCF is preferably about 12 PCF (or in the range of 8 PCF to 12 PCF). As yet another example, a full length resilient composite such as about 1 inch wide, about ½ inch thick, and about 96 inches long can be used, and then its PCF is also preferably about 10 PCF (or in the range of 8 PCF to 12 PCF) as well as the spacing between rows of resilient components being farther apart. The combination of dimensions and density are considered together for final configuration and spacing of machined grooves and resilient components, all to achieve the desired reaction to impacts occurring on active floor section 108 and preferably doing so uniformly and substantially consistently, over time. Resilient components can be adjoining to underside 102 within respective offset grooves by adhesive or mechanical attachment.

In other preferred aspects, and in reference to FIGS. 8 and 9, there is a bottom view of subfloor panel 106 showing an alternate embodiment in which pieces of resilient components 105 are placed within elongated machined grooves 101. In FIG. 8, these grooves extend the length 100*a* of section 100. However, as seen in FIG. 9, the grooves can extend a distance less than the length 100*a* of the subfloor section. For example, the groove can form a plurality of groove pockets 101*c* and each groove pocket can be spaced from each other groove pocket, with the resilient component being a plurality of resilient components and one component located in each groove pocket, as in FIG. 9. As seen in this figure, machined grooves 101 do not run continuously the full length of the subfloor panel 106 but are intermittently spaced for placement of resilient components 105. In such an embodiment, isolated machined grooves 101 can be spaced 12 inches on center in all directions but can be adjusted to an unlimited selected spacing.

The resilient component can be manufactured from polyurethane foam, flexible rubber, recycled rubber/foam, and other elastomers associated with desired resilient characteristics, as taught herein (i.e., polyurethane open cell foam, polyethylene closed cell foam, natural rubber, synthetic rubber). Non-limiting examples of resilient materials that would be suitable for use as the resilient component of the invention, in combination with the teachings herein, are as follows: urethane bonded granulated rubber from Ultimate RB™ of Delphos, Ohio, and similar products from other recycled granulated rubber pad manufacturers such as Ecore™ International of Lancaster, Pa. and Regupol™ America of Lebanon, Pa.

Each and every document cited in this present application, including any cross referenced or related patent or application, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Unless expressly indicated to the contrary, the numerical parameters set forth in the present application are approximations that can vary depending on the desired properties sought to be obtained by a person of ordinary skill in the art without undue experimentation using the teachings disclosed in the present application. Modifications and other embodiments will be apparent to a person of ordinary skill in the active floor arts, and all such modifications and other embodiments are intended and deemed to be within the scope of the present invention.

What is claimed is:

1. A subfloor assembly that supports a flooring section on a substrate, the subfloor assembly comprising:

a subfloor section including an offset groove in an underside of the subfloor section;

the offset groove defined by a side of the groove spaced apart from an opposing side of the offset groove and a ceiling spanning between the side and the opposing side and sloped relative to an upper surface of the substrate;

a resilient component positioned in the offset groove and between the ceiling and the upper surface of the substrate; and wherein the resilient component has a resilient elastic modulus that results in a gap formed between the resilient component and the upper surface of the substrate when the subfloor assembly is in an unloaded state.

2. The subfloor assembly of claim 1, wherein the resilient member is deformed and substantially no gap formed between the resilient component and the upper surface of the substrate when the subfloor assembly is in a loaded state.

3. The subfloor assembly of claim 1, wherein the resilient component has a resilient elastic modulus, and the modulus is substantially uniform throughout a thickness of the resilient component.

4. The subfloor assembly of claim 1, wherein the resilient component is a substantially homogenous resilient elastic material.

5. The subfloor assembly of claim 1, wherein the resilient component has a 90-degree parallelogram cross-sectional profile.

6. The subfloor assembly of claim 5, wherein the cross-sectional profile is rectangular.

7. The subfloor assembly of claim 1, wherein the subfloor section has a length and the groove extends a distance substantially coextensive with the length of the subfloor section.

8. The subfloor assembly of claim 7, wherein the resilient component has a component length substantially coextensive with the length of the subfloor section.

9. The subfloor assembly of claim 7, wherein the resilient component has a component length less than the length of the subfloor section and the resilient component comprises at least two spaced apart resilient components.

10. The subfloor assembly of claim 9, wherein at least two spaced apart resilient components are sized substantially the same.

11. The subfloor assembly of claim 1, wherein the resilient component has a positioned-width contained substantially completely within a width-profile of the offset groove defined by the side of the offset groove spaced apart from the opposing side of the offset groove.

12. The subfloor assembly of claim 11, wherein the positioned-width of the resilient component is contained substantially completely within the profile of the offset groove occurs when the subfloor assembly is in a loaded state.

13. The subfloor assembly of claim 1, wherein the subfloor section includes at least two offset grooves on the underside of the subfloor section, and each offset groove is spaced from each adjacent offset groove.

14. The subfloor assembly of claim 1, wherein the subfloor section has a length and the offset groove extends a distance less than the length of the subfloor section.

15. The subfloor assembly of claim 14, wherein the offset groove forms a plurality of groove pockets and each groove pocket is spaced from each adjacent groove pocket and the resilient component is a plurality of resilient components and one component is located in each groove pocket.

16. The subfloor assembly of claim 1, wherein the side is a short wall and the opposing side is a long wall and the long wall extends a greater depth into the groove than the short wall and each wall adjoins the ceiling.

17. The subfloor assembly of claim 16, wherein the short wall is substantially parallel to the long wall.

18. The subfloor assembly of claim 1, comprising multiple subfloor assemblies adjoining each other.

19. The subfloor assembly of claim 1, comprising the subfloor section located underneath and adjoining a midfloor section located underneath and adjoining a flooring section.

20. A subfloor assembly that supports a flooring section on a substrate, the subfloor assembly comprising:

a subfloor section including an offset groove in an underside of the subfloor section;

the offset groove defined by a side of the offset groove spaced apart from an opposing side of the offset groove and a ceiling spanning between the side and the opposing side and sloped relative to an upper surface of the substrate; and, a resilient component has a rectangular cross-sectional profile and:

(i) is positioned in the offset groove between the ceiling and the upper surface of the substrate, (ii) is a substantially homogenous resilient elastic material, and (iii) has a positioned-width contained substantially completely within a width-profile of the offset groove defined by the side of the offset groove spaced apart from the opposing side of the offset groove.

21. The subfloor assembly of claim 20, wherein the subfloor section includes at least two offset grooves on the underside of the subfloor section, each offset groove is spaced from each adjacent offset groove, and the resilient component comprises a plurality of resilient components with one resilient component located in each offset groove.

22. A subfloor assembly that supports a flooring section on a substrate, the subfloor assembly comprising:

a subfloor section including an offset groove in an underside of the subfloor section; and the offset groove defined by a short wall of the offset groove spaced apart from and substantially parallel to an opposing long wall of the offset groove with a ceiling adjoined to an inside end of each wall and spanning between the walls wherein the long wall extends a greater depth into the offset groove than the short wall; and, a resilient component has a 90-degree parallelogram cross-sectional profile and:

(i) is positioned in the offset groove between the ceiling and an upper surface of the substrate, and (ii) has a resilient elastic modulus where the modulus is substantially uniform throughout a thickness of the resilient component.

23. A subfloor assembly that supports a flooring section on a substrate, the subfloor assembly comprising:

a subfloor section including an offset groove in an underside of the subfloor section;

the offset groove defined by a side of the groove spaced apart from an opposing side of the groove and a ceiling spanning between the side and the opposing side and sloped relative to an upper surface of the substrate;

a resilient component positioned in the offset groove and between the ceiling and the upper surface of the substrate;

wherein the resilient component has a 90-degree parallelogram cross-sectional profile.

* * * * *